United States Patent [19]

Chambliss

[11] 4,097,782

[45] Jun. 27, 1978

[54] ENERGY SAVING MEANS REDUCING POWER USED BY LAMPS

[76] Inventor: Hiram Darden Chambliss, 1900 N. 5th St., Grand Junction, Colo. 81501

[21] Appl. No.: 640,980

[22] Filed: Dec. 15, 1975

[51] Int. Cl.[2] ..... H05B 39/09

[52] U.S. Cl. ..... 315/209 R; 315/194; 315/208; 315/246; 315/291; 315/DIG. 4

[58] Field of Search ..... 315/194, 199, 208, 209 R, 315/224–226, 265, 287, 291, 360, DIG. 4, DIG. 5, DIG. 7; 323/18

[56] References Cited

U.S. PATENT DOCUMENTS

| | | | |
|---|---|---|---|
| 3,619,716 | 11/1971 | Spira et al. | 315/208 X |
| 3,648,106 | 3/1972 | Engel et al. | 315/291 |
| 3,671,804 | 6/1972 | Church | 321/18 X |
| 3,691,404 | 9/1972 | Swygert, Jr. | 315/292 X |
| 3,885,197 | 5/1975 | Moses | 315/194 |
| 3,909,668 | 9/1975 | Laakmann et al. | 315/209 R |

FOREIGN PATENT DOCUMENTS

| | | | |
|---|---|---|---|
| 2,271,665 | 12/1975 | France | 315/200 R |

*Primary Examiner*—Eugene R. LaRoche
*Attorney, Agent, or Firm*—Laurence R. Brown

[57] ABSTRACT

Energy is saved in lighting lamps by pulse operation at periodic duty cycles of less than 100% on time with little effect on apparent brightness when viewed by the normal human eye because of the quality of retention of a peak flask for a finite time. At periodic frequencies above about fourteen cycles the lamps appear to be continuously energized with little flicker.

12 Claims, 5 Drawing Figures

FIG. 4
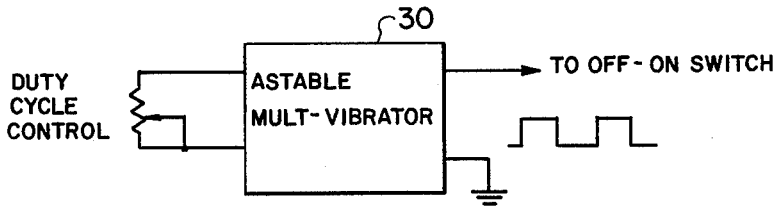
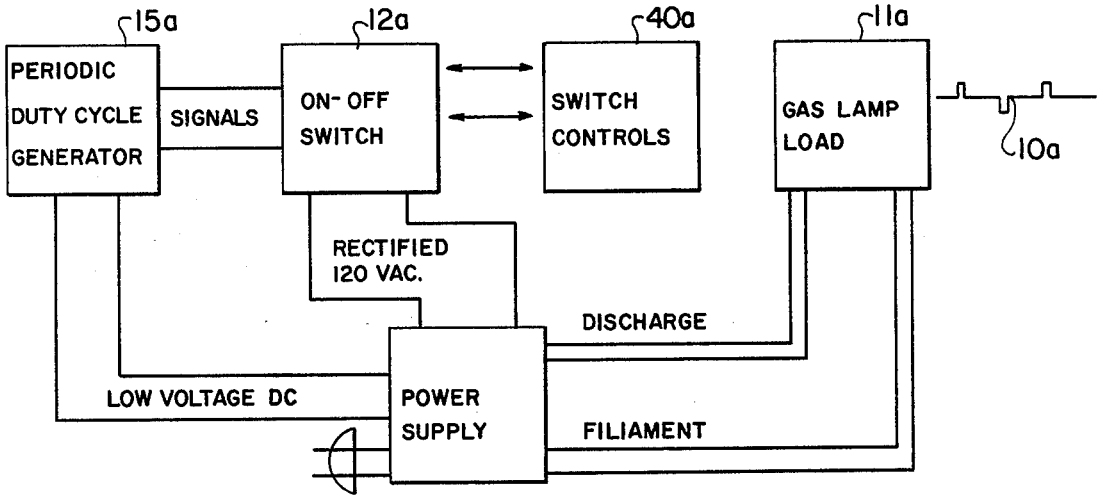
FIG. 5

ENERGY SAVING MEANS REDUCING POWER USED BY LAMPS

This invention relates to lamplighting and more particularly it relates to electronic switching systems for controlling the connection of a power source to light a lamp.

BACKGROUND OF THE INVENTION

In the U.S. traffic signal lamps use about $10^7$ KWH of power each day. Thus a significant energy saving in this field alone could be realized if operating power for lighting lamps could be reduced.

It has been customary to reduce power expenditure in lamps such as traffic signal lamps that are on in both daytime and nighttime by reducing brightness at night. U.S. Pat. No. 3,500,455 issued Mar. 10, 1970 illustrates such dimming circuits.

OBJECT OF THE INVENTION

However, it is the general object of this invention to reduce power without causing the lamps to appear dimmed to human observers.

A more specific object of the invention is to save energy in the operation of traffic signals in daytime use.

BRIEF DESCRIPTION OF THE INVENTION

For lamps that are viewed by the normal human eye, such as traffic signals, it has been discovered that power can be reduced significantly by use of the physiological phenomena of retentivity of light for a finite period by the eye. Thus, the peak intensity flash is observed and will be reinforced by another peak flash during the retentivity time. Accordingly, a low duty cycle of lamp on-time can be tolerated with little apparent dimming, and thus a power saving is realized.

THE DRAWINGS

Figure 1:
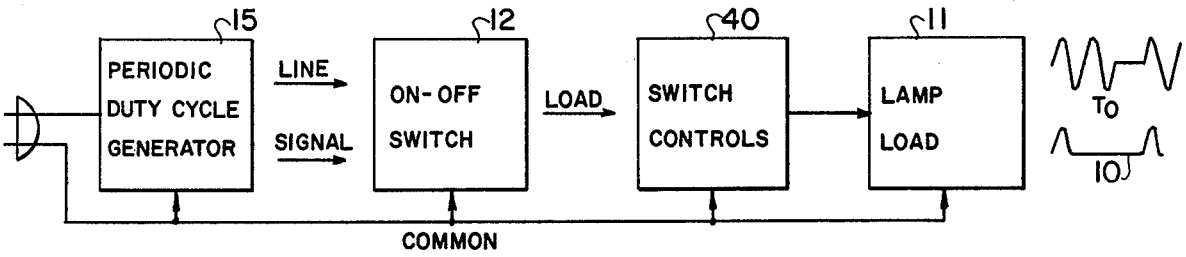
Figure 2:
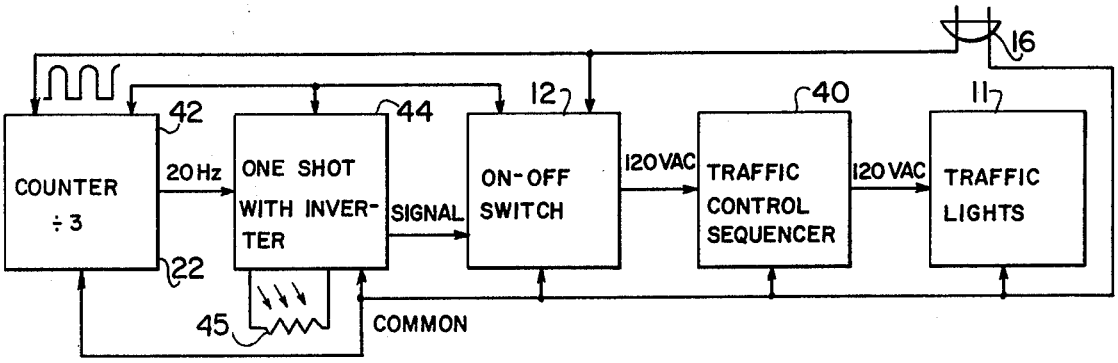
Figure 3:
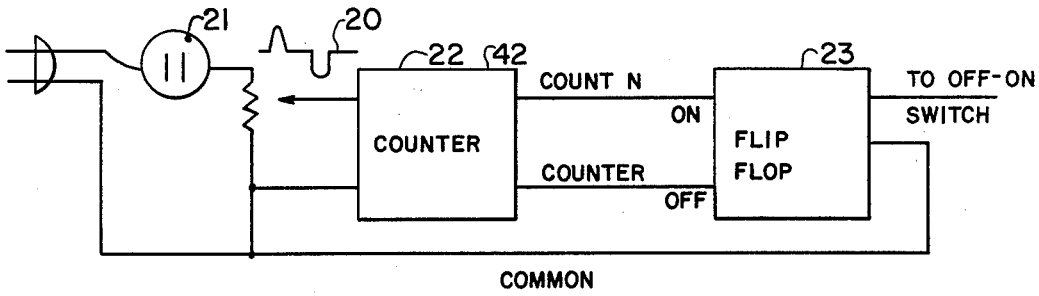

The foregoing together with further objects, features and advantages of the invention will become apparent from the following more detailed description of the invention and reference to the accompanying drawing, wherein:

FIG. 1 is a block schematic diagram of a circuit configuration embodying the invention, FIG. 2 is a block schematic diagram of a further embodiment of the invention, FIGS. 3 and 4 are block schematic diagrams of further embodiments of duty cycle generators operable with the invention, and FIG. 5 is an alternative block schematic embodiment of the invention.

THE DETAILED DESCRIPTION

In FIG. 1, waveform 10 illustrates the power on-off characteristic delivered to a lamp load 11 from an on-off switch 12 as commanded by a periodic duty cycle generator 15. The preferable duty cycle produced is one which lights the lamp at a duty cycle of significantly less than 100% thereby to save more power.

OPERATIONAL MODE

The periodic rate of the duty cycle generator 15 is chosen at a frequency of about 14 Hz or above to establish a physiological condition to the normal human eye that retains the peak brightness flash from one on cycle until the next and therefore will produce an appearance of high brightness while only using partial power since the on/off switch 12 disconnects power to the lamp load 11 from power line 16.

It is to be recognized that some human eyes are more sensitive to flicker than others, and the sensation of flicker increases as lamp brightness increases to some degree, so that an optimum frequency may exceed 14 Hz. Also under some conditions the flicker itself from lower switching frequencies is important to catch attention, and is preferable. The circuit, however, does not flash on and off the lamp at slow rates such as a flashing sign or a flashing yellow traffic signal, but operates at a frequency preferably in the order of 5 Hz or above.

When the lamp is incandescent, then the on-cycle must last long enough to thermally heat the filament to full brightness, which can be accomplished by turning the lamp on continuously for a part of an every three or four cycle period derived from a 60 Hz alternating current source at respectively 20 or 15 Hz periodic rates. It has been found that unexpectedly high power efficiencies are obtained in incandescent lamp switching since at these switching frequencies the filament does not fully cool and thus the amount of current required to relight the lamp is decreased over slower periodic rates. Also, these higher rates of periodic switching will reduce apparent flicker, particularly when the lamps are not at high brightness. Thus, when the filament of an incandescent lamp is chosen to have a longer thermal decay inertia, the resistance when the lamp is reswitched on is higher and less initial switching on current is required.

For example, $1\frac{1}{2}$ cycles on and $1\frac{1}{2}$ cycles off will bring filament temperatures up, resulting in greater brilliance and less power used than when half cycles are applied continuously although both are half-duty cycles.

It is found that at 60 Hz with two cycles on one off, illustrated by the waveform in FIG. 1, no reduction of brilliance was apparent in traffic light signals even in daylight operation with high intensity ambient light conditions. For commensurate nighttime brightness a duty cycle of one-half cycle on and $2\frac{1}{2}$ cycles off illustrated by waveform 10 in FIG. 1 wherein the $T_O$ represents a range from the top waveform to the lower waveform, proved adequate. This accounted for power savings approximately of $\frac{1}{4}$ and $\frac{3}{4}$ (rather than $\frac{1}{3}$ and 5/6) respectively since some extra lighting power is necessary to warm up a cooler lower resistance incandescent filament.

THE CIRCUIT CONFIGURATIONS

As seen in FIG. 1, the duty cycle generator 15 may be circuitry as shown in FIGS. 2, 3 and 4. In FIG. 2, a counting pulse 20 is derived from 110 volt 60 Hz alternating current by means of a resistor-diode-capacitor circuit. This frequency is divided by 3 by counter 22 (20 Hz) which fires a one-shot, 44, 20 times per second. The pulse width of the one shot is established by the resistance of photoresistor 45 whose resistance is greatest at night and a corresponding time constant capacitor in a conventional manner for setting time constants in a one-shot circuit. A short pulse width is desired at night since the energy saving can be greater because of the contrast effecting the human eye in observing the light. Lights are then caused to switch in a waveform similar to 10 in FIG. 1 where a single half cycle or a multiple of complete half cycles $T_O$ of 60 Hz power may be used. The two waveforms typify alternative day and night power cycles, where each operation causes savings in energy because of the gaps where no power is supplied to the lamps. Preferably the switching rate turns on an incandescent lamp for 1½ cycles and off for 1½ cycles to give a brightness to the viewer in most daylight locations equivalent to continuously energized lamps while saving substantially 40% of the operating power at rated lamp voltage.

An astable multivibrator 30 as shown in FIG. 4 could also be used in place of counter 22 of FIG. 2 to generate a switching waveform, but it is preferably to synchronize energization with alternating current power source zero voltage crosspoints, and to prevent any phasing action caused by asynchronous switching that might produce a moving flicker pattern.

The on-off switch 12 of FIG. 1 may be well known thyristor circuits shown for example in RCA application note publication AN-4537, which provides for gating of triac solid state switches for control of lamp circuits. This is the same type of switching circuit used for flashing or sequencing traffic signals for example, and is available in off-the-shelf integrated circuit form.

FIG. 2 illustrates one preferred embodiment of the invention, where switch controls 40 may indicate either off-on switches or traffic sequence control devices passing current from source 16 to lamp load 11. Power may be otherwise obtained for the circuit block elements, such as from d-c power supplies, but is indicated schematically by leads from power line terminal 41 and ground.

A conventional 3 count (or if desired 4) counter 42 operates from line frequency to give a 20 Hz output periodic frequency at one-shot multivibrator circuit 44. This multivibrator has an on-time duty cycle time-constant RC circuit with photo-resistor 45 which when inverted produces a lower duty cycle or narrower on-pulse for nighttime operation than for daytime operation. This significantly reduces power necessary to operate lamps such as those employed in traffic control signals for example.

As seen by comparing FIG. 1 and FIG. 5, there are some differences in block diagram arrangements. FIG. 1 can be used to switch incandescent lamps and FIG. 5 to switch gaseous discharge lamps. Incandescents light up slowly so high frequencies are not applicable and 120 VAC 60 Hz, while not ideal is probably the most economical for particular circuitry cost.

Zero voltage switching has many advantages over other means of reducing power to these lamps. It can pulse half-pulses long enough to bring the filament to near full brilliance, then go off duty to save power during the eye's retentivity. It also gives a soft start each period which greatly extends life expectancy, and offers an efficient method of dimming when desired.

As shown in FIG. 5, the periodic duty cycle generator may be a high frequency oscillator divided down or gated by a counter to produce firing pulses to the on-off switch, since a gaseous lamp load may be flashed brightly for physiological retention by the eye with a very short duty cycle.

The power supply 13 provides both discharge power and filament power to the gas lamp if it is of a nature that requires a hot filament. Greater energy savings are attained with flash type bulbs, not having filament heat requirements, where the firing pulses may be short and the energy gaps between are long so that the firing duty cycle is low. Also for non-filament type gas lamps, the greater energy needed to heat up a filament is not necessary. The incandescent lamp filament requires greater energy to heat to incandescence after it is switched off, and therefore gas lamps generally prove to produce light more efficiently with less energy in accordance with the teachings of this invention.

It is also noted in connection with FIG. 2, that traffic control sequencers 40 are well known in the art, and that this invention has particular advantage in working with such sequencers to modify the lamp lighting function in the way taught herein for lights in any switching mode.

There is even an advantage under some circumstances in switching at a slow enough rate to provide some degree of flicker to the human eye, for the purpose of catching and directing attention to the traffic signals. This can be accomplished at the power line frequency (60 Hz) for example, by switching on for two cycles and off for four. In the daytime where lights are brighter, the flicker is more noticeable. If the flicker aspect is adopted, even greater energy savings can be achieved.

Therefore having described the invention and preferred embodiments thereof, those novel features believed descriptive of the spirit and scope of the invention are defined with particularity in the appended claims.

What is claimed is:

1. Energy saving means for reducing power used by lamps employing means reducing power without significant reduction of apparent brightness as viewed by the normal human eye, comprising in combination, a traffic signal incandescent lamp, a switching circuit for selectively providing upon command lamp lighting power at a predetermined lighting voltage for said lamp, and a command circuit actuating said switching circuit periodically including equipment providing a normal daytime mode of operation for lighting said lamp while in use in daytime brightness at a duty cycle of less than 100% and at a frequency between 5 Hz and 30 Hz to retain some of the brightness of one lighting pulse by the human eye until the next lighting pulse occurs, thereby constituting equipment with an operating mode whereby said power is decreased for lighting the lamp without a corresponding reduction in viewed brightness wherein said power for said lamp is supplied from an alternating current power source having a frequency N of 60 Hertz, and wherein said command circuit respectively turns on and off said lamp over a duration of on and off pulses having an integral number of successive half cycles.

2. The combination defined in claim 1 wherein the periodic frequency of lighting said lamp is greater than 14 hertz whereby the lamp does not appear to flicker significantly when viewed by the normal human eye.

3. The combination defined by claim 1 with a periodic switching frequency low enough to produce a pulsating sensation to the normal human eye.

4. The combination defined by claim 1 operable from an alternating current power source including a periodic generator for said command circuit comprising a multivibrator circuit triggered for one shot synchronously with the alternating waveform and having an R-C frequency determining circuit including a photo responsive resistor responsive to ambient light level.

5. The combination defined by claim 1 including an alternating current power source wherein a neon lamp circuit is connected to derive pulses from said alternating current and counter circuits are actuated by said derived pulses to produce said duty cycle.

6. The combination defined by claim 1 wherein the lamp is an incandescent lamp.

7. The combination defined in claim 1 wherein the lamp on-time duty cycle is less than 50%.

8. The combination defined by claim 1 wherein the periodic switching frequency for said lamp is low enough that the eye can detect some degree of flicker.

9. The combination defined in claim 1 wherein the command circuit produces a duty cycle with two cycles on and one cycle off.

10. The combination defined in claim 1 wherein the command circuit produces a duty cycle with one-half cycle on and 2½ cycles off.

11. The combination defined in claim 1 wherein said command circuit has a periodic frequency generator comprising a counter deriving count pulses and a circuit producing therefrom energy to turn on said lamp.

12. The combination defined by claim 11 including light responsive means changing the function for day and night operation in the sense that the duty cycle is greater for day operation than night.

* * * * *